US006371104B1

(12) United States Patent
Voohris

(10) Patent No.: US 6,371,104 B1
(45) Date of Patent: Apr. 16, 2002

(54) CONVECTION OVEN WITH GAS BURNER

(75) Inventor: Daniel P. Voohris, Fort Wayne, IN (US)

(73) Assignee: Wayne/Scott Fetzer Company, Fort Wayne, IN (US)

( * ) Notice: Subject to any disclaimer, the term of this patent is extended or adjusted under 35 U.S.C. 154(b) by 0 days.

(21) Appl. No.: 09/621,190

(22) Filed: Jul. 21, 2000

(51) Int. Cl.[7] ..... F24C 3/00; F24C 15/32
(52) U.S. Cl. ..... 126/21 A; 126/273 R
(58) Field of Search ..... 126/21 A, 110 D, 126/273 R; 239/566, 567, 568; 432/222, 159; 34/97

(56) References Cited

U.S. PATENT DOCUMENTS

| | | | |
|---|---|---|---|
| 1,618,024 | A | 2/1927 | Roberts |
| 2,253,178 | A | 8/1941 | Hennessy |
| 2,300,156 | A | 10/1942 | Higley |
| 3,322,347 | A | 5/1967 | Pierce |
| 3,384,068 | A | 5/1968 | Perry et al. |
| 3,463,469 | A | 8/1969 | Shelley |
| 3,568,934 | A | 3/1971 | Dunn |
| 3,605,717 | A | 9/1971 | Sauer |
| 3,698,377 | A | 10/1972 | Smith |
| 3,719,180 | A | 3/1973 | Pere |
| 3,921,913 | A | 11/1975 | Capy |
| 3,926,106 | A | 12/1975 | Deusing et al. |
| 4,055,132 | A | 10/1977 | Stohrer, Jr. et al. |
| 4,108,139 | A | 8/1978 | Gilliom et al. |
| 4,336,789 | A | 6/1982 | Ogawa |
| 4,418,456 | A | 12/1983 | Riehl |
| 4,430,989 | A | 2/1984 | Narang et al. |
| 4,446,777 | A | 8/1984 | Weber |
| 4,484,885 | A | 11/1984 | Machii et al. |
| 4,492,839 | A | 1/1985 | Smith |
| 4,498,453 | A | 2/1985 | Ueda |
| 4,506,652 | A | 3/1985 | Baker et al. |
| 4,516,012 | A | 5/1985 | Smith et al. |
| 4,576,090 | A | 3/1986 | Burtea |
| 4,648,377 | A | 3/1987 | Van Camp |
| 4,789,333 | A | 12/1988 | Hemsath |
| 4,813,398 | A | 3/1989 | Savage |
| 4,926,837 | A | 5/1990 | Parker et al. |
| 5,121,737 | A | 6/1992 | Yencha, III |
| 5,257,927 | A | 11/1993 | Lang |
| 5,328,357 | A | 7/1994 | Reihl |
| 5,568,803 | A | 10/1996 | Brown |
| 5,601,070 | A | 2/1997 | Hotard et al. |
| 5,655,511 | A | 8/1997 | Prabhu et al. |
| 5,676,049 | A | 10/1997 | Arnold |
| 5,727,539 | A | 3/1998 | Broom |
| 5,732,614 | A | 3/1998 | Oslin |
| 5,816,234 | A | 10/1998 | Vasan |
| 5,845,631 | A | 12/1998 | Kleva et al. |
| 5,859,540 | A | 1/1999 | Fukumoto |
| 5,915,372 | A | 6/1999 | Wiedemann et al. |

*Primary Examiner*—Sara Clarke
(74) *Attorney, Agent, or Firm*—Wood, Herron & Evans LLP

(57) ABSTRACT

A burner for a gas convection oven comprises an annular-shaped burner tube having outer peripheral slots and two gas input ends. The burner is disposed about the outer periphery of a fan and a cylindrical sleeve is disposed between the fan and tube as an inner burner baffle. An annular ring extends radially outward from the downstream end of the sleeve as an outer baffle. The burner and fan are disposed in the same chamber and are used in both commercial and residential ovens and ranges.

17 Claims, 6 Drawing Sheets

CONVECTION OVEN WITH GAS BURNER

FIELD OF THE INVENTION

This invention relates to convection ovens and more particularly to a gas burner for a fan-driven convection apparatus.

BACKGROUND OF THE INVENTION

Convection ovens are well known in the art. They are heated, in a convection mode by both electrical heaters and by gas-fired burners. Generally, where gas-fired burners are used, the heating operation is done in one of two ways. Either the burner is located in a separate chamber from the fan, buffered from its turbulence, or an indirect heat exchanger is interposed between the gas burner and the fan. Disclosures of several electrical heating element ovens suggest that a gas burner could be used in place of the electric heating element, but none of these prior disclosures show how this can be done.

More particularly, the use of a gas burner in a convection oven is problematic and generally requires either a separate, buffered burner chamber or an interposed heat exchanger. This is due to the problem of sustaining adequate flame configuration in the presence of the turbulent air flow in the same chamber or area as the fan. The fan flow turbulence has a tendency to separate the flame from its anchoring burner and to extinguish the flame, severely incapacitating the efficiency of the burner. Also, the flame must be lit or initiated when the burner is turned on. Turbulent air flow in the fan chamber affects the ignition operation and hampers flame ignition, blowing the gas away from the ignitor.

Moreover, electric heating elements in convection ovens have several disadvantages. First, since the element heats around its entire surface area, it also radiates heat onto the back surfaces of the oven structure so that some of the heat radiated is wasted and does not reach the cooking chamber. Secondly, such convection ovens are generally preheated using a broiler burner. Once the preheat reaches a certain level, the broiler element is turned off and the convection element is turned on. There is a lag in the electric convection element from the time it is turned on to the time it reaches its appropriate operating temperature. Therefore, the preheat temperature in the oven drops off, and some of the preheat energy is lost.

Accordingly, it has been one objective of this invention to provide an improved convection oven with an operable, efficient gas burner disposed in the same area as the convection fan.

Another objective of the invention has been to provide an improved gas burner for a convection oven.

SUMMARY OF THE INVENTION

To these ends a gas, convection burner according to one embodiment of the invention overcomes these difficulties and provides an effective gas burner for use in a convection oven. This is accomplished by several factors. First, the burner is formed of a tube having a circular, rectangular, or square cross-section and preferably bent in a circular configuration. Preferably two inlet ends of the tube are interconnected to a fitting, which itself is connected to a gas source.

A series of slots are located in preferably the outer periphery or face of the tube. Each of these slots is 0.1875 to one inch long and approximately 0.018" to 0.023" wide. The circular cross-section tube is about one-half to three-quarters inch in diameter with 0.035 inches wall thickness, and forms a circular shape of about 7.25 inches outside diameter. Tubing of other cross-sectional shapes may be of similar or equivalent dimensions as desired. The burner configuration produces a short, tight and stable flame with the gas pressure at each of the slots from the respective tube inputs remaining relatively consistent. It has been found that when a burner of this configuration is utilized in a convection oven environment, together with a fan for blowing heated air into a convection cooking chamber; even the turbulent flow of the fan does not blow out the flames.

Preferably, the burner is disposed around the outer periphery of a convection fan. A short, cylindrical sleeve extends along the fan axis between the fan outer periphery and the burner, and serves as an inner burner baffle. A flat ring extends radially from proximate the downstream end of the cylindrical sleeve, with respect to air flow through the fan, at least coextensively with and preferably outwardly of the outer periphery of the annular burner and near one side of the annular burner. This ring serves as an outer burner baffle.

A direct spark ignitor or HSI (hot surface igniter), as well known in the industry, is utilized. Once the igniter gets a start signal, it begins to spark or glow, until a flame rectification rod indicates the presence of a flame on the burner. If that does not occur within a preset time duration of, say, six seconds or so, the voltage to the gas valve is dropped off and the gas valve closes for safety reasons.

Such a gas burner, when used in a convection oven, produces several advantages. For example, since the flame is in or proximate the fan path, and in the same chamber as the fan, most of the heat generated by the burner is directed by the air flow into the chamber and is not wasted radiating in other directions. Secondly, the burner reaches operating temperature much more quickly than does an electric element, reducing preheat energy loss. Accordingly, when used in a convection oven, once a preheat temperature is obtained and the burner turned on, there is much less lag in the desired rise in operating temperature and less heat is lost in the interim. Also, the burner can produce the same temperature gradients as an electric burner so that the processes remain similar in terms of the time and temperature settings for predetermined foods.

Perhaps most importantly, however, the burner described produces a tight flame, not susceptible to being blown out by the convention fan mounted in the same chamber and which can also be ignited despite the ongoing fan flow.

Accordingly, a gas convection burner is provided which can be effectively and efficiently used in a convection oven. The gas burner has the advantage of producing a uniform heat in a shorter duration of time from start up than an electrical element, since its gradient from start to operating temperature is much quicker than a typical electrical burner. At the same time, it provides a heating gradient for a normal heating process similar to the electric heating element, and it does not suffer from flame blow-out or ignition interference even though disposed in the fan turbulence as a gas burner may be expected to do.

It will be appreciated that the gas burner as disclosed herein can be used effectively in many types of convection ovens, both commercial and residential, and has also applications in ranges and ovens for either commercial or residential use.

These and other objectives and advantages will become readily apparent from the following detailed description of a preferred embodiment of the invention and from the drawings in which:

DETAILED DESCRIPTION OF PREFERRED EMBODIMENT

Figure 1:
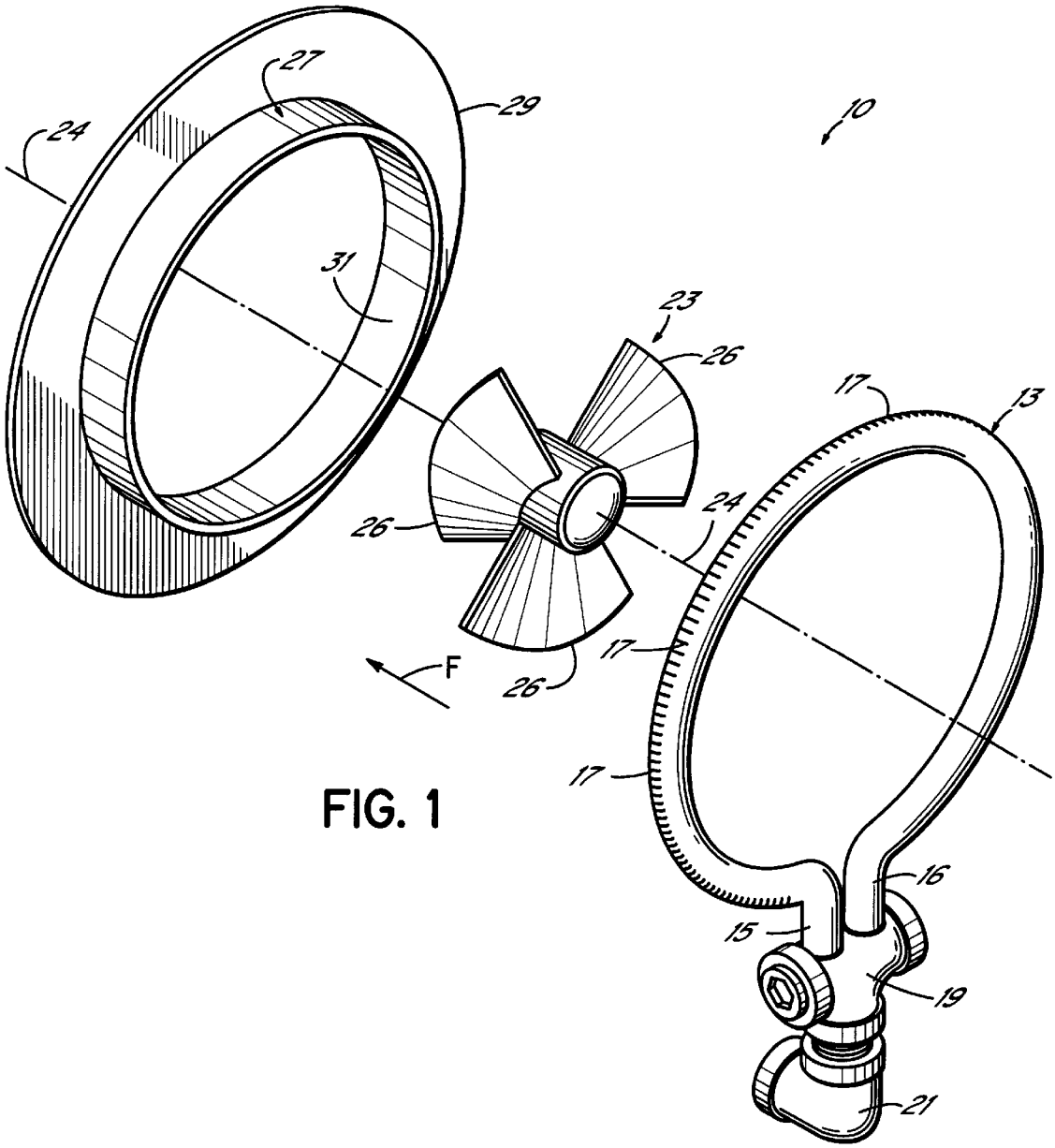
FIG. 1 is an exploded view of the annular gas burner of the invention.
Figure 1A:
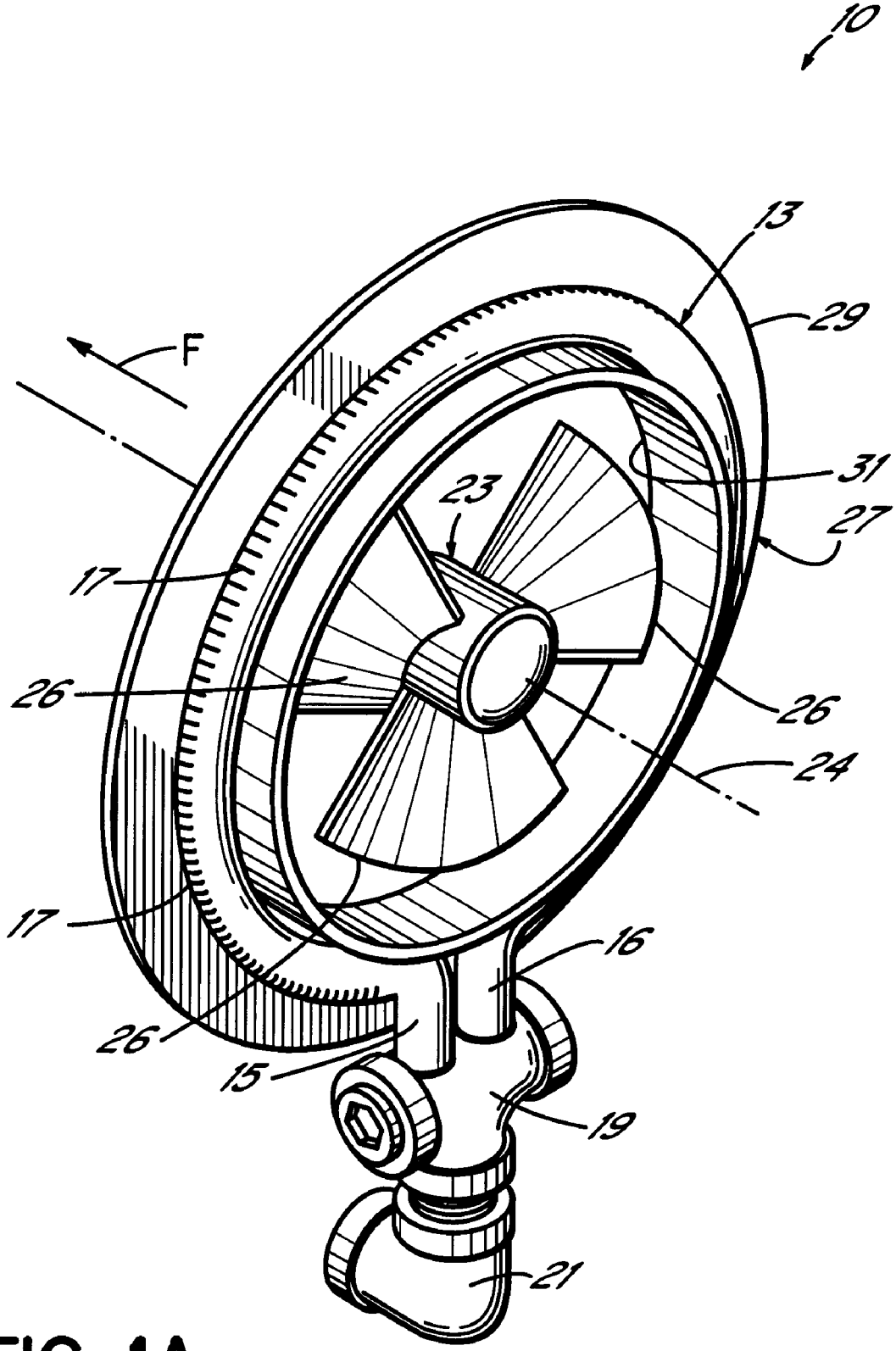
FIG. 1A is a perspective illustration of the burner of FIG. 1 as used.
Figure 2:
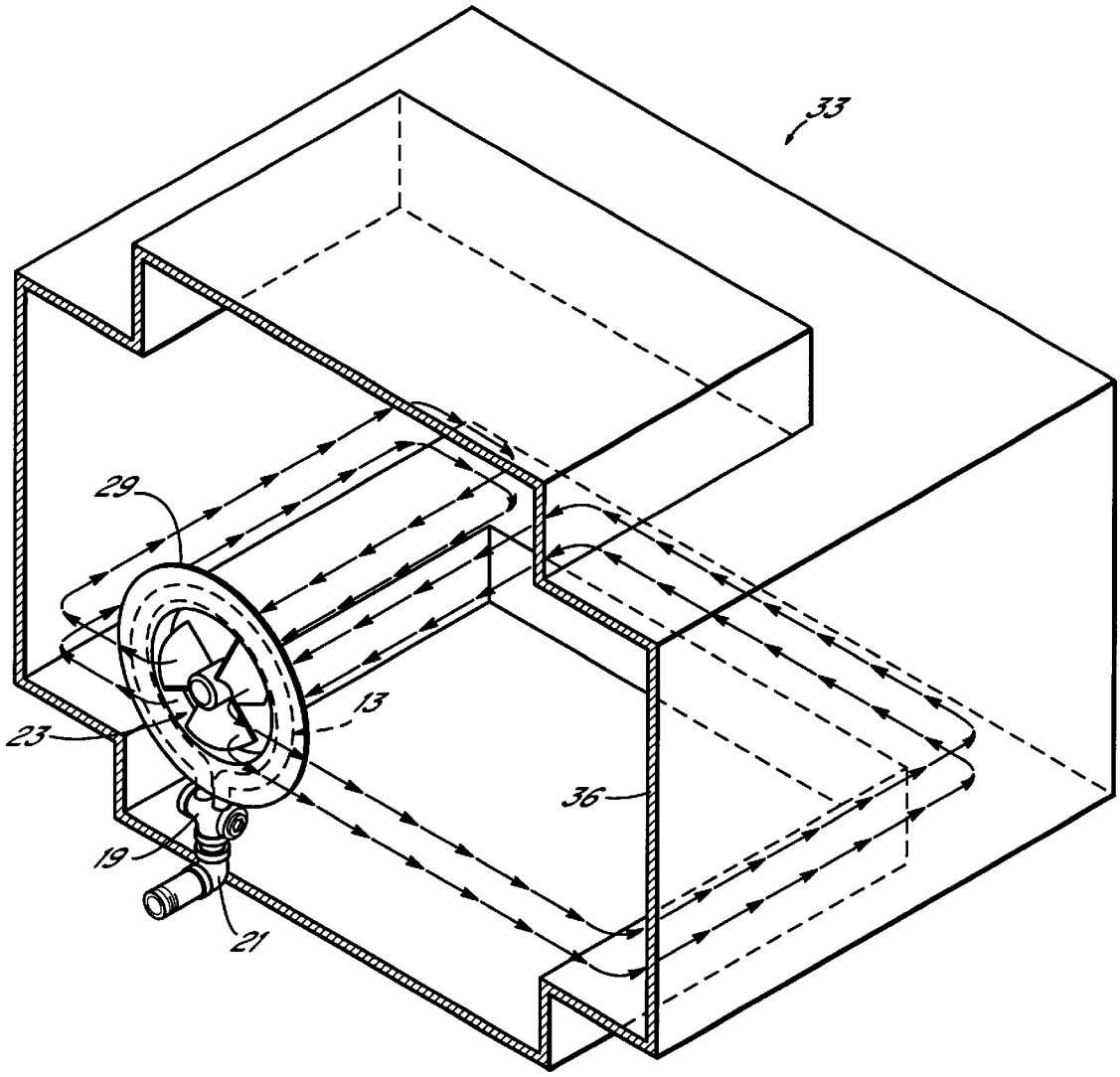
FIG. 2 is a perspective illustration of the invention of FIGS. 1 and 1A in place in a convection cooking chamber and showing the preferred air flow through the oven.

Turning now to the figures, an exploded view of certain elements of the invention are shown in FIG. 1, the elements being shown in operable orientation in FIG. 1A. It will be appreciated that while the invention is described in use in connection with a gas burner convection oven, it also has application and use in varied industrial heating applications for purposes of stress-relief, batch heating; powder coating and other environments where air flow is heated by a gas fired burner. A gas burner 10, described in use in a convection oven is shown in FIG. 2. It will be appreciated that burner 10 can be used in convection ranges or ovens for residential and restaurant or other commercial or industrial applications as noted.

Burner 10 includes a circular cross-section tube 13 and a plurality of slots 17 about the outer periphery or face of the tube 13. Inlet ends 15, 16 are connected to a fitting or manifold 19 and through an elbow 21 to a source of flammable gas. Gas under pressure enters the manifold 19, flows into inlets 15, 16 and out slots 17 for ignition as a flame about the tube 13.

Figure 4:
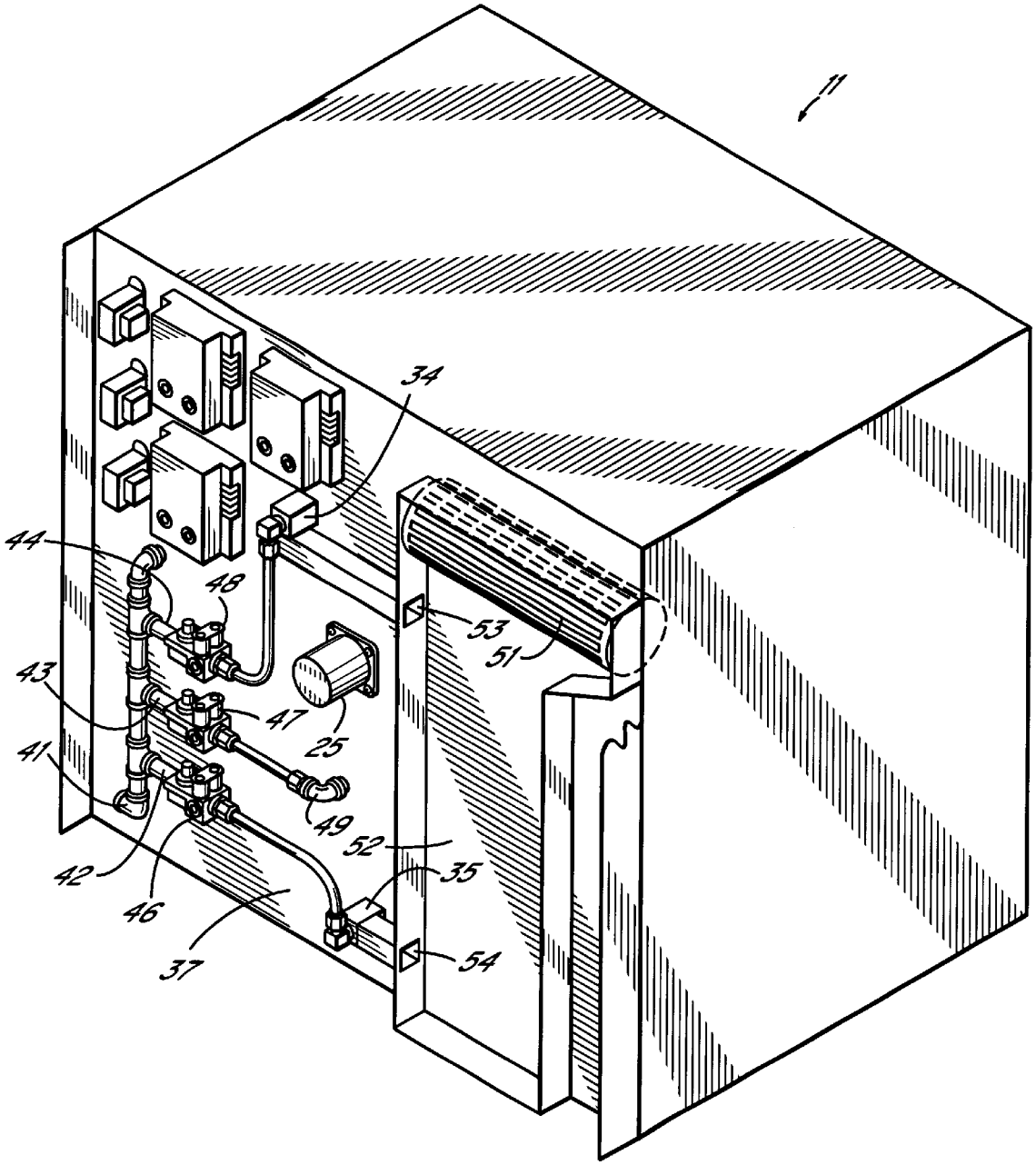
FIG. 4 is a perspective view of the oven of FIGS. 2 and 3, but showing the back side of the oven with gas connections to the respective burners.

A fan 23 is rotatably disposed about an axis 24 for rotation by a motor 25 (FIG. 4).

A cylindrical sleeve 27, defining an inner baffle is disposed about axis 24. A radial flange 29 extends from a downstream end 31 of sleeve 27 (with respect to air flow "F" created by fan 23).

Flange 29 extends outwardly of sleeve 27 preferably even with or just beyond the outward periphery or radial extension of burner tube 13.

When combined operationally (FIG. 1A), the sleeve 27 is interposed between the outer ends 26 of the blades of fan 23.

Figure 3:
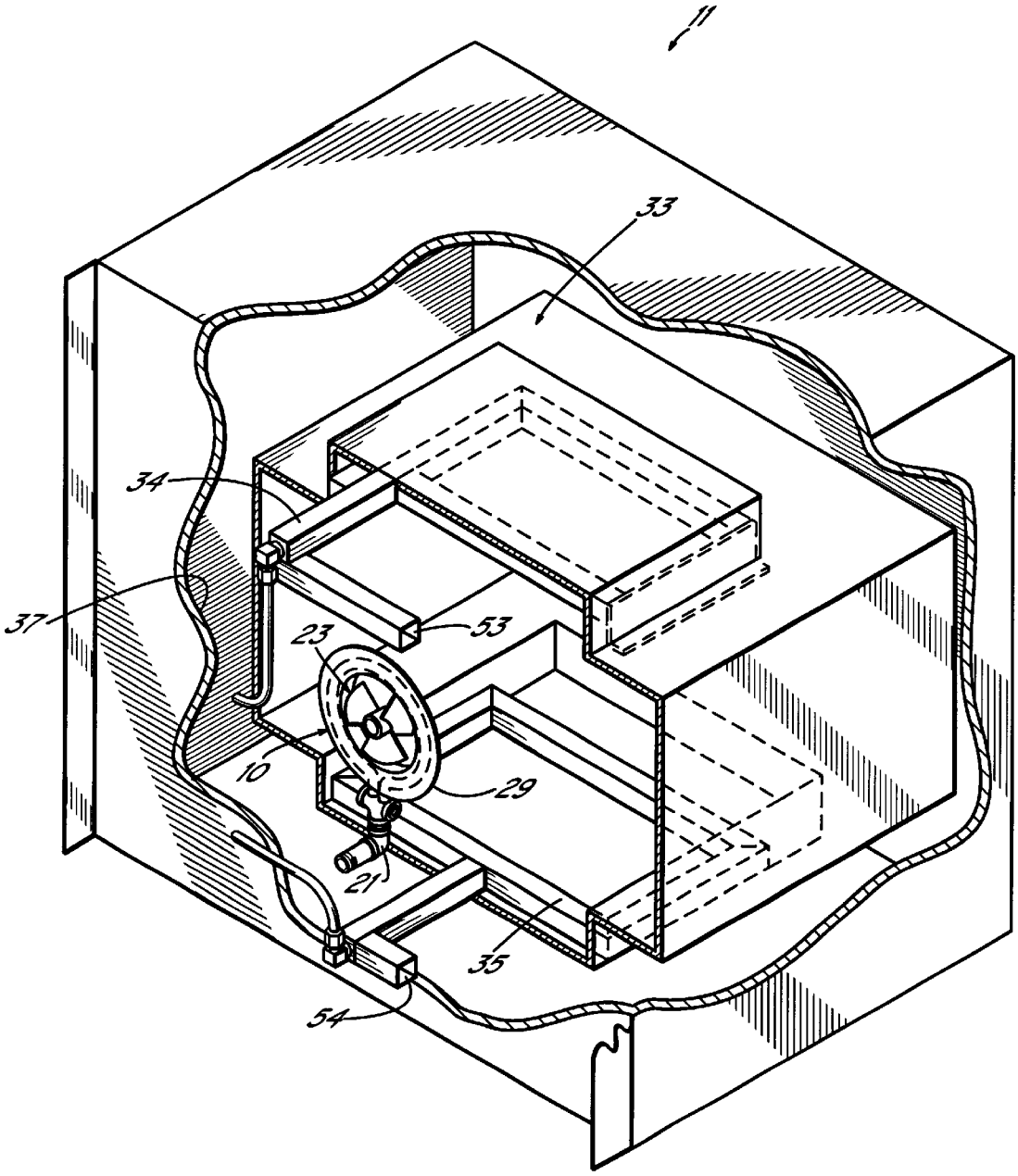
FIG. 3 is a perspective view similar to FIG. 2 but further showing the chamber disposed in an oven and other features of a convection oven.

Turning momentarily to FIG. 3, the burner 10 is shown in conjunction with an oven 11 and more particularly in a heating or convection chamber 33. Burners 34 and 35 are provided for use when normal broiling or baking are desired. These burners 34, 35 can also be used to preheat chamber 33 when desired. In FIG. 3, the rear sides of oven 11 and chamber 33 are exposed for clarity to illustrate the orientation of elements of the invention.

Referring back now to FIG. 2, the chamber 33 with rear end 36, shown open, is heated by convection, with fan 23 circulating heat provided by flames from slots 17 of burner tube 13. Air flow in chamber 33 is shown by the plurality of arrows. The fan 23 draws air from the chamber and blows it outwardly toward rear wall 37 (FIG. 3) of oven 11. The air flows around the rear area of chamber 33, outwardly from flange 29, around and through chamber 33 and back to fan 23. At the same time, steady tight flames burn at slots 17 on burner tube 13 providing heat so that the air circulated, as illustrated by the arrows in FIG. 2, is heated. Of course, the arrows shown are illustrative only and air finds its own way outwardly from fan 23 and back through chamber 33 to evenly heat the chamber and cook food therein.

It will be appreciated that the fan 23 and burner tube 13 are both within the same convection chamber 33. There are no intermediary heat exchangers between the burner tube 13 and chamber 33, nor separate combustion chambers for burner tube 13 apart from chamber 33 in which it resides.

While many details of the burner tube 13, fan 23, sleeve or inner baffle 27 and flange or outer baffle 29 might be varied, the following dimensions and parameters have been found useful. In one embodiment, then, about 140 slots 17 are equally spaced on about 0.125 inches on center around the outer peripheral surface of tube 13. The overall cross-section 13 itself is about ½ inches in outer diameter with a wall thickness of about 0.035 inches. The cross-section is bent annularly so the burner so formed is about 7.25 inches in outside diameter and the distance from the outermost side of tube 13 opposite ends 15, 16 to manifold 19 is about 8.25 inches. Each slot 17 is preferably about 0.1875 inches to 5/16 inches long and about 0.018 or 0.023 inches wide.

The details of FIG. 4 illustrate a backside wall 37 of a convection oven 11 provided with a preferred embodiment of the invention. A gas line 41 is connected to a source of flammable gas (not shown). Line 41 has a plurality of outlets 42, 43, 44. Outlet 42 feeds gas selectively through valve 46 to bake burner 35. Outlet 44 feeds gas selectively through valve 48 to broiler burner 34. Outlet 43 feeds gas selectively through valve 47 to elbow 21, manifold 19, burner tube ends 15, 16 and burner tube 13 to slots 17. Elbow 49 (FIG. 4) connects to elbow 21 in this regard. Fitting tube ends 15, 16 into T-shaped manifold 19 provides gas pressure at both ends of the tube 13. This facilitates and promotes more even or consistent gas pressure at each slot 17 with respect to other slots 17 and is preferred over a single inlet tube.

Combustion air is provided to burners 34, 35 by fan 51, pulling air into chamber 52, from where it is pulled into respective burner air inlets 53, 54.

As shown in the upper lefthand corner of rear wall 37, electronic transformers and power supplies can be oriented here, together with control for a direct spark ignitor (not shown), useful for igniting flame in burner tube 13.

Preferably a direct spark ignitor (not shown) is operated and the gas turned on. If no flame from tube 13 is lit within about 6 seconds, the gas to the tube is turned off for safety reasons. A flame detector, such as a flame rectification rod, of any suitable manufacture, is used to determine the presence of a flame in a well-known manner and generates a signal used in controlling the gas when no flame is present.

It has been found that use of the sleeve 27 and flange 29, extending beyond the outer periphery of tube 13 are useful in facilitating the enduring presence of a tight, stable flame on burner tube 13 at slots 17. The flame stays anchored to the tube 13 and does not separate from the tube in a manner as would cause the flame to blow out in the presence of turbulence from fan 23 in the same chamber 33. Moreover, the gas exuding from slots 17 is consistently ignited by a direct spark ignitor, even in the presence of air turbulence caused by fan 23 in the same chamber 33.

Since the flame from tube 13 is in the air flow, most of the heat generated by the burner is transferred to the air for cooking, and is not wasted by radiation into ineffectual components of the chamber or oven. The burner reaches temperature very quickly as compared to an electric element, thus little chamber heat is lost by delay in thermal climb gradient or start up.

Also, such a convection burner as described herein provides temperature gradients similar to those of electric heater elements. Cooking processes thus remain similar to electrically energized cooking in terms of cook times and temperature settings for predetermined foods.

Alternative Burner Tube

Figure 5A:
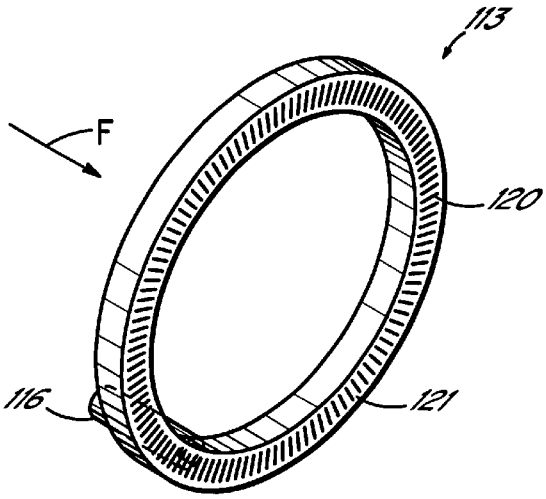
FIG. 5A is an illustrative view of an alternative burner tube.
Figure 5B:
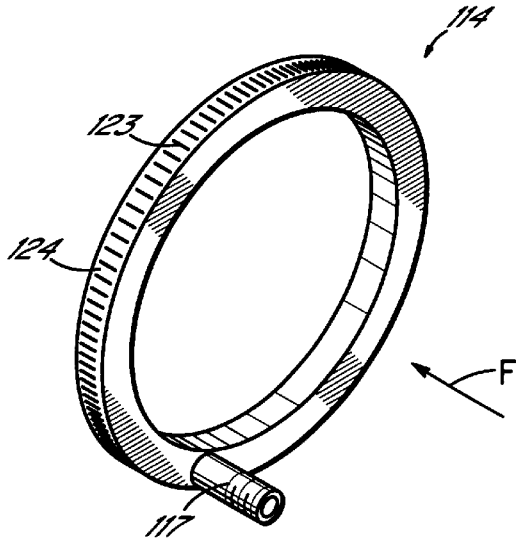
FIG. 5B is an illustrative view of another alternative burner tube.
Figure 5C:
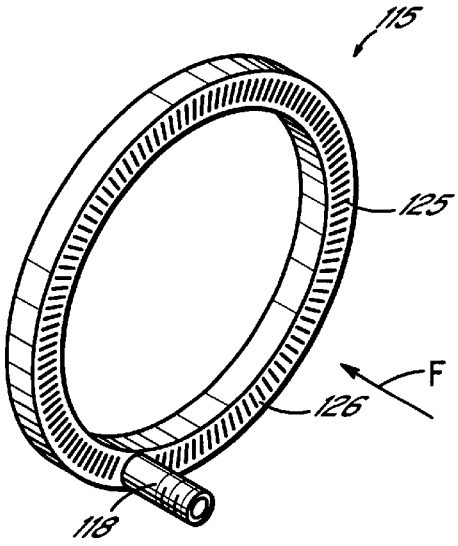
FIG. 5C is an illustrative view of yet another alternative burner tube.

Turning now to FIGS. 5A through 5C, there is shown therein alternative embodiments of burner tubes 113, 114 and 115, respectively. Each of these tubes is of rectangular cross-section, preferably square, and each includes a respective single gas inlet 116, 117 and 118 adapted for connection to a source of gas through an appropriate manifold or fitting (not shown) comparable to manifold 19 and elbow 21, for example. Of course, dual gas inlets could be used at ends of a rectangular tube such as inlets 15, 16 of tube 13.

Tube 113 (FIG. 5A) is provided with a plurality of slots 120 in downstream face 121, with respect to fan flow F therethrough. Tube 114 (FIG. 5B) is provided with slots 123 in outer peripheral face 124. Tube 115 is provided with slots 125 in upstream face 126, with respect to fan flow F.

Each of the slots 120, 123 and 125 are approximately the same size and number as slots 17, described above. The outer annular periphery of tubes 113, 114 and 115 is about 7.25 inches and the tubes are about ½ inch in cross-sectional height with a wall thickness of about 0.035 inch. Other parameters of size may be used.

Tubes 113, 114 and 115 are used as alternatives to tube 13. Use of single gas inlets 116, 117 and 118 is effective to provide gas to all respective slots in the tube for producing a readily ignitable, close, tight and consistent flame when used as described with respect to tube 13. Advantages similar to those obtained with tube 13 are obtained with these alternate tubes.

The invention thus provides a gas burner for a convection oven without need of a heat exchanger or separate or indirect burner chamber. The flame remains stable even in the presence of fan flow in the same chamber as the fan, and ignition is obtained in the presence of such flow. The invention can be dispersed in numerous oven or range locations, front, back, top, bottom or side, and thus facilitates design of any particular unit. It is applicable to both residential and commercial range or oven operations.

Accordingly, many further embodiments, applications and modifications of the invention will become readily apparent to those of ordinary skill in the art without departing from the scope of the invention and applicant intends to be bound only by the claims appended hereto.

I claim:

1. In a gas convection apparatus, a gas burner and a fan wherein said burner comprises an annular burner tube having a plurality of gas outlet slots disposed about an outer periphery of said tube, said tube being operably disposed around an outer periphery of a forced air fan, said fan and said tube being disposed in a common chamber in said apparatus.

2. The apparatus as in claim 1 wherein said annular tube has two ends, each end being connected to a source of pressurized gas.

3. The apparatus as in claim 2 wherein said fan rotates about an axis and further including an annular cylindrical sleeve extending about said axis and disposed between the outer periphery of said fan and said tube, said sleeve comprising an inner baffle.

4. The apparatus as in claim 3 further including an annular ring about said axis, and extending radially from one end of said sleeve, said ring lying in a plane perpendicular to said axis and comprising an outer burner baffle disposed at least coextensively with one side of said annular burner tube.

5. The apparatus as in claim 2 wherein said slots are disposed on centers of about 0.125 inches around the entire annular periphery of said annular burner tube.

6. The apparatus as in claim 1 wherein said slots are spaced about 0.125 inches apart about the outer periphery of said annular burner tube, each slot extending transversely across said tube periphery a distance of about 0.1875 to five-sixteenths inches long and having a width of about 0.018 to about 0.023 inches.

7. The apparatus as in claim 6 wherein said tube's outer periphery is about 7.25 inches in outside diameter.

8. The apparatus as in claim 7 wherein said tube is of circular cross-section.

9. The apparatus as in claim 8 wherein said tube has an outer diameter of about ½ inch.

10. The apparatus as in claim 7 wherein said tube is rectangular in cross-section.

11. The apparatus as in claim 10 wherein said tube is about ½ inch high in a radial direction with respect to said fan.

12. The apparatus as in claim 1 further including a gas-fired heating burner and a gas-fired broiler burner.

13. The apparatus as in claim 1 wherein said fan is rotatable about an axis and further comprising a cylindrical sleeve extending along said axis between the outer periphery of said fan and said annular burner tube, and a flat ring extending radially with respect to said axis from said sleeve outwardly of the outer periphery of said annular tube.

14. A gas burner for use in a fan-generated turbulent air flow, said burner comprising:

an annular tube having an inner periphery and an outer periphery;

a plurality of gas outlet slots disposed in said tube, each slot extending transversely across the outer periphery of said tube;

said tube having two ends;

said tube ends each operatively connectable to a source of combustible gas; and said tube being disposed about a flow generating fan.

15. The burner as in claim 14 wherein said slots are disposed around the annular tube between said tube ends.

16. The burner as in claim 15 wherein said slots are disposed on centers of about 0.125 inches and each slot extends about 0.1875 to five-sixteenths of an inch and is about 0.012 inches wide.

17. The burner as in claim 14 wherein said annular tube is disposed about an axis and further including a cylindrical sleeve extending along said axis proximate the inner periphery of said tube and a plate extending radially with respect to said axis on one side of said tube and proximate one each of said sleeve.

* * * * *